US009879201B2

(12) United States Patent
Akamatsu

(10) Patent No.: US 9,879,201 B2
(45) Date of Patent: Jan. 30, 2018

(54) ENGINE OIL COMPOSITION

(71) Applicant: COSMO OIL LUBRICANTS CO., LTD., Toyko (JP)

(72) Inventor: Atsushi Akamatsu, Satte (JP)

(73) Assignee: COSMO OIL LUBRICANTS CO., LTD., Tokyo (JP)

( * ) Notice: Subject to any disclaimer, the term of this patent is extended or adjusted under 35 U.S.C. 154(b) by 0 days.

(21) Appl. No.: 15/120,797

(22) PCT Filed: Feb. 28, 2014

(86) PCT No.: PCT/JP2014/055039

§ 371 (c)(1),
(2) Date: Aug. 23, 2016

(87) PCT Pub. No.: WO2015/129022

PCT Pub. Date: Sep. 3, 2015

(65) Prior Publication Data

US 2017/0009178 A1 Jan. 12, 2017

(51) Int. Cl.
*C10M 157/00* (2006.01)

(52) U.S. Cl.
CPC ..... *C10M 157/00* (2013.01); *C10M 2205/06* (2013.01); *C10M 2209/084* (2013.01); *C10N 2220/021* (2013.01); *C10N 2220/029* (2013.01); *C10N 2230/02* (2013.01); *C10N 2230/54* (2013.01); *C10N 2240/10* (2013.01); *C10N 2240/102* (2013.01)

(58) Field of Classification Search
CPC ..... C10N 2220/029; C10N 2230/54; C10N 2240/102; C10N 2230/02
USPC ..... 508/591, 469
See application file for complete search history.

(56) References Cited

U.S. PATENT DOCUMENTS 4,849,481 A 7/1989 Rhodes et al.
5,458,791 A 10/1995 Rhodes et al.
6,034,042 A * 3/2000 Rhodes ..... C08F 297/044 508/591
6,303,550 B1 * 10/2001 Wedlock ..... C10M 143/12 508/591
6,869,919 B2 * 3/2005 Ritchie ..... C10M 141/06 508/221
7,718,588 B2 * 5/2010 Morishita ..... C08F 293/005 508/469
8,101,559 B2 * 1/2012 Mueller ..... C08F 220/36 508/469
8,772,211 B2 * 7/2014 Kelley ..... C10M 143/00 508/118
8,937,035 B2 * 1/2015 Qin ..... C10M 145/14 508/287
9,528,060 B2 * 12/2016 Takeshima ..... C10M 169/048
2009/0298729 A1 * 12/2009 Schober ..... C10M 161/00 508/287
2010/0093578 A1 * 4/2010 Tsujimoto ..... C10M 167/00 508/430
2011/0077183 A1 3/2011 Murata et al.
2011/0207642 A1 * 8/2011 Strickland ..... C10M 169/041 508/591
2011/0263470 A1 * 10/2011 Qin ..... C10M 145/14 508/507
2011/0306529 A1 * 12/2011 Schober ..... C10M 161/00 508/273
2014/0005088 A1 * 1/2014 Doan ..... C10M 143/12 508/591
2015/0184105 A1 * 7/2015 Taribagil ..... C10M 169/04 508/591
2015/0184108 A1 * 7/2015 Taribagil ..... C10M 169/041 508/591
2016/0083669 A1 * 3/2016 Yoshida ..... C10M 169/041 508/591
2016/0348026 A1 * 12/2016 Souchik ..... C08F 220/18

FOREIGN PATENT DOCUMENTS

JP 8-048987 A 2/1996
JP 8-302378 11/1996
JP 10-053788 A 2/1998
JP 2001-348591 A 12/2001
JP 2009-221382 A 10/2009
JP 2011-021056 A 2/2011
JP 2011-219632 A 11/2011

OTHER PUBLICATIONS

International Search Report (PCT/ISA/210) issued in PCT/JP2014/055039, dated Apr. 8, 2014.
Written Opinion (PCT/ISA/237) issued in PCT/JP2014/055039, dated Apr. 8, 2014.

* cited by examiner

*Primary Examiner* — Ellen M McAvoy
(74) *Attorney, Agent, or Firm* — Birch, Stewart, Kolasch & Birch, LLP

(57) ABSTRACT

An engine oil composition includes a star polymer (A) and a poly(alkyl (meth)acrylate) (B) as a viscosity index improver, and has a viscosity index of 185 to 230, the star polymer (A) having a star structure and having a weight average molecular weight of 100,000 to 1,000,000, the star structure being a structure in which polymer chains branch from a center of the polymer, the polymer chains being obtained by copolymerization and hydrogenation of an aromatic vinyl compound monomer and a conjugated diene monomer, the poly(alkyl (meth)acrylate) (B) having a weight average molecular weight of 200,000 to 600,000, the content ($M_A$) of the star polymer (A) in the engine oil composition being 0.10 to 2.00 mass % based on the total mass of the engine oil composition, the content ($M_B$) of the poly(alkyl (meth)acrylate) (B) in the engine oil composition being 0.50 to 6.00 mass % based on the total mass of the engine oil composition, and the ratio "$M_A/M_B$" being 0.10 to 1.00. The engine oil composition can significantly improve fuel efficiency, and is suitably used for a diesel engine.

4 Claims, No Drawings

ENGINE OIL COMPOSITION

TECHNICAL FIELD

The present invention relates to an engine oil composition that can significantly improve fuel efficiency. In particular, the invention relates to an engine oil composition that is suitably used for a diesel engine.

BACKGROUND ART

In recent years, a reduction in $CO_2$ emissions from automotive exhaust gas has been strongly desired in view of global warming. It is effective to increase the travel distance with a limited amount of fuel (i.e., improve the fuel efficiency of automobiles) in order to reduce $CO_2$ emissions from automobiles. It is known that an improvement in hardware (internal combustion engine) and an improvement in engine oil (i.e., lubricant) significantly contribute to an improvement in fuel efficiency of automobiles.

For example, an engine oil for which the friction coefficient in a boundary lubrication region is reduced by adding a friction modifier such as an organomolybdenum compound is known as an engine oil that improves fuel efficiency (see Patent Literature 1 and 2, for example).

It is also effective to improve the viscosity characteristics of an engine oil in order to improve fuel-efficiency. For example, it is known that an engine oil composition to which a specific viscosity index improver is added either alone or in combination improves fuel efficiency (see Patent Literature 3 to 5, for example).

CITATION LIST

Patent Literature

Patent Literature 1: JP-A-8-302378 (claims)
Patent Literature 2: JP-A-2001-348591 (claims)
Patent Literature 3: JP-A-2011-21056 (claims)
Patent Literature 4: JP-A-10-53788 (claims)
Patent Literature 5: JP application No. 2008-68415 (claims)

SUMMARY OF INVENTION

Technical Problem

However, an engine oil that can further improve fuel efficiency has been desired, and the existing technology is not necessarily satisfactory. A low-viscosity gasoline engine oil that conforms to the SAE viscosity grade 5W-20 or 0W-20 specified by SAE J300 is widely marketed as an oil that improves fuel efficiency.

On the other hand, since a diesel engine is higher in cylinder internal pressure as compared with a gasoline engine, and is frequently used under high load, a significant decrease in viscosity of an engine oil that aims to reduce friction in a hydrodynamic lubrication region may result in a decrease in wear resistance due to the lack of film strength, adversely affect the durability of the engine, and increase friction in a boundary lubrication region. Specifically, it is difficult to sufficiently improve fuel efficiency when the measures applied to a gasoline engine are applied to a diesel engine. Moreover, since a large amount of soot (i.e., combustion product) produced by a diesel engine is mixed into an engine oil, the effect of reducing friction in a boundary lubrication region through the use of an organomolybdenum compound (that is widely applied to a gasoline engine) may decrease to a large extent due to soot, and a sufficient effect may not be obtained.

Therefore, it is necessary to take technical measures differing from those applied to a gasoline engine that do not excessively decrease viscosity and do not use an organomolybdenum compound in order to develop an engine oil that is used for a diesel engine and improves fuel efficiency.

An object of the invention is to provide an engine oil composition that can significantly improve fuel efficiency, and is suitably used for a diesel engine.

Solution to Problem

In view of the above situation, the inventors conducted extensive studies with regard to an engine oil composition that can improve fuel efficiency. As a result, the inventors found that an engine oil composition of which the viscosity index is adjusted to a value within a specific range using viscosity index improvers having a specific structure in combination can significantly improve fuel efficiency. This finding has led to the completion of the invention.

According to one aspect of the invention, an engine oil composition includes a star polymer (A) and a poly(alkyl (meth)acrylate) (B) as a viscosity index improver, and has a viscosity index of 185 to 230, the star polymer (A) having a star structure and having a weight average molecular weight of 100,000 to 1,000,000, the star structure being a structure in which polymer chains branch from the center of the polymer, the polymer chains being obtained by copolymerization and hydrogenation of an aromatic vinyl compound monomer and a conjugated diene monomer, the poly(alkyl (meth)acrylate) (B) having a weight average molecular weight of 200,000 to 600,000, the content ($M_A$) of the star polymer (A) in the engine oil composition being 0.10 to 2.00 mass % based on the total mass of the engine oil composition, the content ($M_B$) of the poly(alkyl (meth) acrylate) (B) in the engine oil composition being 0.50 to 6.00 mass % based on the total mass of the engine oil composition, and the ratio ($M_A/M_B$) of the content ($M_A$) of the star polymer (A) to the content ($M_B$) of the poly(alkyl (meth) acrylate) (B) being 0.10 to 1.00.

Advantageous Effects of Invention

One aspect of the invention thus provides an engine oil composition that can significantly improve fuel efficiency, and is suitably used for a diesel engine.

DESCRIPTION OF EMBODIMENTS

An engine oil composition according to one embodiment of the invention includes a star polymer (A) and a poly(alkyl (meth)acrylate) (B), and has a viscosity index of 185 to 230, the star polymer (A) having a star structure and having a weight average molecular weight of 100,000 to 1,000,000, the star structure being a structure in which polymer chains branch from the center of the polymer, the polymer chains being obtained by copolymerization and hydrogenation of an aromatic vinyl compound monomer and a conjugated diene monomer, the poly(alkyl (meth)acrylate) (B) having a weight average molecular weight of 200,000 to 600,000, the content ($M_A$) of the star polymer (A) in the engine oil composition being 0.10 to 2.00 mass % based on the total mass of the engine oil composition, the content ($M_B$) of the poly(alkyl (meth)acrylate) (B) in the engine oil composition being 0.50 to 6.00 mass % based on the total mass of the engine oil composition, and the ratio ($M_A/M_B$) of the content ($M_A$) of the star polymer (A) to the content ($M_B$) of the poly(alkyl (meth)acrylate) (B) being 0.10 to 1.00.

The engine oil composition according to one embodiment of the invention includes a base oil and various additives. The engine oil composition according to one embodiment of the invention includes the star polymer (A) and the poly (alkyl (meth)acrylate) (B) as a viscosity index improver.

The base oil included in the engine oil composition according to one embodiment of the invention may be one base oil, or two or more base oils, selected from a mineral base oil and a synthetic base oil. The base oil may be a mixture including a mineral base oil and a synthetic base oil.

Example of the mineral base oil include a mineral base oil obtained by refining a lubricant fraction produced from crude oil by appropriately combining a solvent refining process, a hydrorefining process, a hydrocracking process, a hydro-dewaxing process, and the like. Examples of the base oil having a viscosity index of 125 or more (described below) include a highly refined paraffinic mineral oil (high-viscosity-index mineral oil-based lubricant base oil) obtained by subjecting a hydrotreated oil, a catalytically isomerized oil, and the like to a solvent dewaxing process, a hydro-dewaxing process, and the like.

Examples of the synthetic base oil include an isoparaffin (that is synthesized from natural gas (e.g., methane)), an α-olefin oligomer, a dialkyl diester, a polyol, an alkylbenzene, a polyglycol, a phenyl ether, and the like.

The properties of the base oil are not particularly limited as long as the base oil has properties suitable for a normal engine oil composition. In order to obtain an engine oil composition that can implement better fuel efficiency, it is preferable that the base oil have a kinematic viscosity at 100° C. (measured in accordance with JIS K 2283 (ASTM D445)) of 3 to 12 $mm^2/s$ and a viscosity index (measured in accordance with JIS K 2283 (ASTM D2270)) of 120 or more. It is more preferable that the base oil have a kinematic viscosity at 100° C. of 3 to 7 $mm^2/s$ and a viscosity index of 125 or more. It is still more preferable that the base oil have a kinematic viscosity at 100° C. of 3.5 to 5.0 $mm^2/s$ and a viscosity index of 130 or more. The base oil may be produced by mixing an American Petroleum Institute (API) Group II base oil (sulfur content: 0.03 mass % or less, saturated content:90 mass % or more, viscosity index: 80 to less than 120) and an API Group III base oil (sulfur content: 0.03 mass % or less, saturated content:90 mass % or more, viscosity index: 120 or more) so that the properties fall within the above ranges. Note that it is preferable to use a base oil that belongs to Group III or higher in order to obtain excellent fuel efficiency.

The engine oil composition according to one embodiment of the invention includes the star polymer (A) and the poly(alkyl (meth)acrylate) (B) that function as a viscosity index improver.

The star polymer (A) has a star structure in which polymer chains branch from the center of the polymer. Specifically, the star polymer (A) has a structure in which polymer chains are bonded to the center of the polymer. The polymer chains included in the star polymer (A) are obtained by the copolymerization and hydrogenation of an aromatic vinyl compound monomer and a conjugated diene monomer.

Examples of the star polymer (A) include a star polymer obtained by copolymerizing one or more monomers selected from an aromatic vinyl compound monomer and one or more monomers selected from a conjugated diene monomer to obtain a copolymer, reacting the copolymer with a polyalkenyl coupling agent, and hydrogenating the resulting product. The star polymer (A) thus obtained has a structure in which a structural site derived from the polyalkenyl coupling agent that has been reacted with the copolymer of the aromatic vinyl compound monomer and the conjugated diene monomer, and then hydrogenated, forms the center of the star polymer (A), or a structural site derived from the polyalkenyl coupling agent that has been reacted with the copolymer of the aromatic vinyl compound monomer and the conjugated diene monomer, and then hydrogenated, and part of the copolymer of the aromatic vinyl compound monomer and the conjugated diene monomer, form the center of the star polymer (A), and the polymer chains obtained by the copolymerization and hydrogenation of the aromatic vinyl compound monomer and the conjugated diene monomer branch from the center of the star polymer (A).

The aromatic vinyl compound monomer is an aromatic compound that includes a vinyl group, or an alkylated product thereof. Examples of the aromatic vinyl compound monomer include syrene, methylstyrene, ethylstyrene, vinylnaphthalene, alkylated products thereof, and the like. It is preferable to use styrene as the aromatic vinyl compound monomer.

Examples of the conjugated diene monomer include a conjugated diene such as butadiene, isoprene, 2-methylbutadiene, 2,3-dimethylbutadiene, 2-ethylbutadiene, 2,3-diethylbutadiene, pentadiene, 2-methylpentadiene, and 3-methylpentadiene. It is preferable to use butadiene or isoprene as the conjugated diene monomer.

When copolymerizing the aromatic vinyl compound monomer and the conjugated diene monomer, the aromatic vinyl compound monomer is preferably used (copolymerized) in a ratio of 5 to 35 mass %, and particularly preferably 5 to 25 mass %, based on the total mass of the monomers, and the conjugated diene monomer is preferably used (copolymerized) in a ratio of 65 to 95 mass %, and particularly preferably 75 to 95 mass %, based on the total mass of the monomers.

Examples of the polyalkenyl coupling agent include an aliphatic polyalkenyl compound such as polyvinylacetylene, polyallylacetylene, diacetylene, and a dimethacrylate, and an aromatic polyalkenyl compound such as divinylbenzene, trivinylbenzene, tetravinylbenzene, divinyl-o-xylene, m-xylene, p-xylene, trivinyl-o-xylene, trivinyl-m-xylene, trivinyl-p-xylene, tetravinyl-o-xylene, tetravinyl-m-xylene, tetravinyl-p-xylene, divinylnaphthalene, divinylethylbenzene, divinylbiphenyl, diisobutenylbenzene, diisopropenylbenzene, and diisopropenylbiphenyl. Among these, an aromatic polyalkenyl compound is preferable, and divinylbenzene is particularly preferable.

Examples of the star polymer (A) include a styrene-butadiene-isoprene star polymer that includes polymer chains obtained by the copolymerization and hydrogenation of styrene, butadiene, and isoprene, and a styrene-isoprene star polymer that includes polymer chains obtained by the copolymerization and hydrogenation of styrene and isoprene. The styrene-butadiene-isoprene star polymer is obtained by copolymerizing styrene, butadiene, and isoprene to obtain a copolymer, reacting the copolymer with a polyalkenyl coupling agent (e.g., divinylbenzene), and hydrogenating the resulting product. The styrene-isoprene star polymer is obtained by copolymerizing styrene and isoprene to obtain a copolymer, reacting the copolymer with a polyalkenyl coupling agent (e.g., divinylbenzene), and hydrogenating the resulting product. The styrene-butadiene-isoprene star polymer and the styrene-isoprene star polymer obtained as described above include divinylbenzene at the center of the molecular structure.

The star polymer (A) included in the engine oil composition according to one embodiment of the invention is obtained by copolymerizing the aromatic vinyl compound monomer and the conjugated diene monomer to obtain a copolymer, reacting the copolymer with the polyalkenyl coupling agent, and hydrogenating the resulting product. Therefore, the star polymer (A) includes only a small amount of unsaturated bonds derived from the conjugated diene. It is preferable that the star polymer (A) have a low degree of unsaturation derived from the conjugated diene. It is preferable that the star polymer (A) include a repeating unit derived from the conjugated diene that includes an unsaturated bond in a ratio of 20 mass % or less, more preferably 10 mass % or less, and still more preferably 5 mass % or less, based on the total amount of repeating unit derived from the conjugated diene.

The star polymer (A) has a star structure in which polymer chains formed of a hydrogenated copolymer of the aromatic vinyl compound monomer and the conjugated diene monomer branch from the center of the polymer. The number of polymer chains included in the star polymer (A) is 3 or more, preferably 5 or more, and particularly preferably 7 or more. When the number of polymer chains included in the star polymer (A) is 5 or more, it is possible to easily adjust the weight average molecular weight of the star polymer (A) to a value within the range described below, and easily obtain excellent shear stability.

The weight average molecular weight of the star polymer (A) is 100,000 to 1,000,000, preferably 150,000 to 800,000, more preferably 400,000 to 700,000, and still more preferably 500,000 to 700,000. If the weight average molecular weight of the star polymer (A) is less than 100,000, the star polymer (A) may not exhibit a sufficient viscosity-increasing effect when used as a viscosity index improver. If the weight average molecular weight of the star polymer (A) exceeds 1,000,000, sufficient shear stability may not be obtained, and the engine oil may decrease in viscosity due to shear during long-term use, whereby a decrease in wear resistance or seizure resistance may occur. Note that the term "weight average molecular weight" used herein refers to a polystyrene-equivalent weight average molecular weight measured using a GPC system "TOSOH HLC-8020", a column "TSK-gel GMHHR-M" (×3), and a refractive index detector (mobile phase: THF) at a flow rate of 1 ml/min, a sample concentration of about 1.0 mass %/Vol % THF, and an injection volume of 50 μl.

The star polymer (A) may be used either alone or in combination.

The poly(alkyl (meth)acrylate) (B) is a polymer that includes a structural unit represented by the following formula (1).

Formula (1)

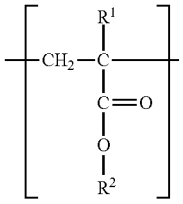

wherein $R^1$ is a hydrogen atom or a methyl group, and $R^2$ is a linear or branched alkyl group having 1 to 50 carbon atoms.

The poly(alkyl (meth)acrylate) (B) is a polymer that includes the structural unit represented by the formula (1). Specifically, the poly(alkyl (meth)acrylate) (B) may be a polymer produced using only a methacrylate or an acrylate as a monomer (i.e., a polymer that includes only the structural unit represented by the formula (1)), or may be a copolymer of a methacrylate or an acrylate and an additional monomer (i.e., a polymer that includes the structural unit represented by the formula (1), and a structural unit other than the structural unit represented by the formula (1)). $R^1$ in the structural unit represented by the formula (1) included in the poly(alkyl (meth)acrylate) (B) may be either identical to each other or different from each other. The poly(alkyl (meth)acrylate) (B) may be a dispersion-type poly(alkyl (meth)acrylate) that includes a polar group (e.g., amino group and sulfonic acid group), or may be a non-dispersion-type poly(alkyl (meth)acrylate) that does not include a polar group.

The weight average molecular weight of the poly(alkyl (meth)acrylate) (B) is 200,000 to 600,000, preferably 250,000 to 500,000, and particularly preferably 300,000 to 450,000. If the weight average molecular weight of the poly(alkyl (meth)acrylate) (B) is less than 200,000, a sufficient improvement in fuel efficiency may not be obtained due to a decrease in viscosity index-improving effect. If the weight average molecular weight of the poly(alkyl (meth) acrylate) (B) exceeds 600,000, sufficient shear stability may not be obtained, and the engine oil may decrease in viscosity due to shear during long-term use, whereby a decrease in abrasion resistance or seizure resistance may occur. Moreover, the coking resistance of the engine oil composition may be adversely affected.

The poly(alkyl (meth)acrylate) (B) may be used either alone or in combination.

The content of the star polymer (A) in the engine oil composition according to one embodiment of the invention is 0.10 to 2.00 mass %, preferably 0.20 to 1.50 mass %, more preferably 0.25 to 1.25 mass %, and still more preferably 0.30 to 1.00 mass %, based on the total mass of the engine oil composition. The star polymer (A) exhibits excellent shear stability. If the content of the star polymer (A) is less than 0.10 mass %, the shear stability of the engine oil composition may deteriorate since the content of the poly (alkyl (meth)acrylate) (B) that exhibits inferior shear stability relatively increases. If the content of the star polymer (A) exceeds 2.00 mass %, the viscosity of the engine oil composition may unnecessarily increase since the star polymer (A) tends to exhibit a low viscosity index-improving effect as compared with the poly(alkyl (meth)acrylate) (B), and exhibit an insufficient effect of decreasing the high-temperature high-shear viscosity in the effective region that significantly affects fuel efficiency. Moreover, since the content of the poly(alkyl (meth)acrylate) (B) relatively decreases, the engine oil composition according to one embodiment of the invention may not have a viscosity index of 185 to 230, and the high-temperature high-shear viscosity in the effective region may increase. Therefore, it may be difficult to sufficiently improve fuel efficiency.

The content of the poly(alkyl (meth)acrylate) (B) in the engine oil composition according to one embodiment of the invention is 0.50 to 6.00 mass %, preferably 0.70 to 4.50 mass %, more preferably 0.85 to 3.00 mass %, and still more preferably 1.00 to 2.00 mass %, based on the total mass of the engine oil composition. The poly(alkyl (meth)acrylate)

(B) normally exhibits an excellent viscosity index-improving effect, but tends to exhibit inferior shear stability and coking resistance. If the content of the poly(alkyl (meth) acrylate) (B) is less than 0.50 mass %, the engine oil composition according to one embodiment of the invention may not have a viscosity index of 185 to 230, and it may be difficult to sufficiently improve fuel efficiency. If the content of the poly(alkyl (meth)acrylate) (B) exceeds 6.00 mass %, the viscosity of the engine oil composition may unnecessarily increase, and it may be difficult to improve fuel efficiency. Moreover, the practical performance such as shear stability and coking resistance may be adversely affected.

When the star polymer (A) or the poly(alkyl (meth) acrylate) (B) is diluted with a diluent oil, the content of the star polymer (A) or the poly(alkyl (meth)acrylate) (B) refers to the content of the active component (polymer) excluding the diluent oil.

The ratio ($M_A/M_B$) of the content ($M_A$) (mass %) of the star polymer (A) based on the total mass of the engine oil composition to the content ($M_B$) (mass %) of the poly(alkyl (meth)acrylate) (B) based on the total mass of the engine oil composition is 0.10 to 1.00, preferably 0.12 to 0.75, and particularly preferably 0.15 to 0.50. When the ratio ($M_A/M_B$) is within the above range, it is possible to easily obtain an engine oil composition that has a viscosity index of 185 to 230 and exhibits excellent shear stability.

The engine oil composition according to one embodiment of the invention necessarily includes the star polymer (A) and the poly(alkyl (meth)acrylate) (B) as the viscosity index improver. The engine oil composition according to one embodiment of the invention may optionally further include an additional viscosity index improver. Examples of the additional viscosity index improver include a known viscosity index improver such as an olefin copolymer, polyisobutylene and a derivative thereof, a polyalkylstyrene, and a styrene-maleic anhydride ester copolymer (that may include a dispersion group). Note that fuel efficiency may be adversely affected if the content of the additional viscosity index improver is too high, and it is desirable to minimize the content of the additional viscosity index improver. The content of the additional viscosity index improver is preferably 5 mass % or less, and particularly preferably 2 mass % or less, based on the total content of the star polymer (A) and the poly(alkyl (meth)acrylate) (B).

The engine oil composition according to one embodiment of the invention may optionally further include various additives in addition to the viscosity index improver.

The engine oil composition according to one embodiment of the invention may include an ash-free dispersant. Examples of the ash-free dispersant include a succinimide-based dispersant represented by the following general formula (2) or (3), and the like. A product obtained by modifying the succinimide represented by the general formula (2) or (3) with boron may also be used as the ash-free dispersant.

General formula (2)

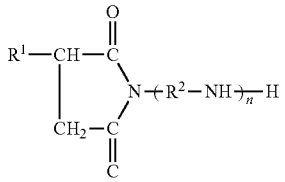

-continued

General formula (3)

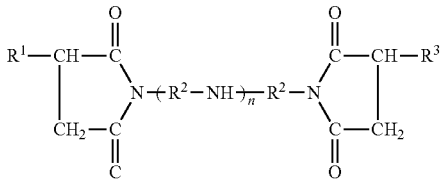

In the general formulas (2) and (3), $R^1$ and $R^3$ are an alkyl group or an alkenyl group, and preferably a polybutenyl group. The weight average molecular weight is 300 to 10,000, preferably 500 to 8,000, and more preferably 800 to 6,000. $R^1$ and $R^3$ are either identical or different. $R^2$ is an alkylene group having 2 to 5 carbon atoms. The number of carbon atoms of the alkylene group is preferably 2 or 3. n is an integer from 1 to 10. The weight average molecular weight of the dispersant represented by the general formula (2) or (3) is preferably 500 to 20,000, more preferably 1,000 to 15,000, still more preferably 3,000 to 13,000, and most preferably 4,000 to 10,000. When the weight average molecular weight of the dispersant is within the above range, it is possible to obtain a diesel engine oil that exhibits sufficient dispersibility.

The ash-free dispersant may be a combination of one succinimide-based dispersant, or two or more succinimide-based dispersants, among the succinimide-based dispersant represented by the general formula (2) and the succinimide-based dispersant represented by the general formula (3), and one succinimide-based dispersant, or two or more succinimide-based dispersants, among a product obtained by modifying the succinimide-based dispersant represented by the general formula (2) with boron and a product obtained by modifying the succinimide-based dispersant represented by the general formula (3) with boron. It is preferable to use boron-modified succinimide in order to achieve high heat resistance required for a diesel engine oil.

The content of the succinimide-based dispersant in the engine oil composition is not particularly limited, but is preferably 100 to 2,000 ppm by mass, and more preferably 300 to 1,500 ppm by mass (on a nitrogen atom basis), based on the total mass of the engine oil composition. When using boron-modified succinimide as the succinimide-based dispersant, the content of boron-modified succinimide in the engine oil composition is preferably 50 to 2,000 ppm by mass, more preferably 75 to 1,000 ppm by mass, still more preferably 100 to 500 ppm by mass, and most preferably 150 to 400 ppm by mass (on a boron atom basis), based on the total mass of the engine oil composition. Since the succinimide-based dispersant has very high viscosity, and may adversely affect the viscosity characteristics of the engine oil composition, it is desirable to minimize the content of the succinimide-based dispersant in order to maintain high fuel efficiency.

The engine oil composition according to one embodiment of the invention may include a zinc dialkyldithiophosphate. When the engine oil composition includes a zinc dialkyldithiophosphate, the engine oil composition exhibits improved anti-wear performance. The zinc dialkyldithiophosphate may include an alkyl group derived from a primary alcohol, an alkyl group derived from a secondary alcohol, or both an alkyl group derived from a primary alcohol and an alkyl group derived from a secondary alcohol. The number of carbon atoms of the alkyl group is not particularly limited, but is preferably 3 to 12 from the viewpoint of an improvement in anti-wear performance.

The content of the zinc dialkyldithiophosphate in the engine oil composition according to one embodiment of the invention is preferably 0.01 to 0.20 mass %, and particularly preferably 0.03 to 0.14 mass % (on a phosphorus atom basis), based on the total mass of the engine oil composition. If the content of the zinc dialkyldithiophosphate is less than 0.01 mass %, the desired anti-wear performance may not be obtained. If the content of the zinc dialkyldithiophosphate exceeds 0.20 mass %, the oxidation stability of the engine oil may be adversely affected due to sulfuric acid and the like produced from a decomposition product of the zinc dialkyldithiophosphate.

The engine oil composition according to one embodiment of the invention may include a metal-based detergent. Examples of the metal-based detergent include an alkaline-earth metal salicylate, an alkaline-earth metal sulfonate, an alkaline-earth metal phenate, and the like. These metal-based detergents may be used either alone or in combination. It is preferable to use an alkaline-earth metal salicylate as metal-based detergent since a decrease in friction can be achieved.

The engine oil composition according to one embodiment of the invention may include an antioxidant. Examples of the antioxidant include a phenol-based antioxidant, an amine-based antioxidant, an organomolybdenum-based antioxidant, and the like. These antioxidants may be used either alone or in combination. Examples of the phenol-based antioxidant include a phenol-based compound such as an alkylphenol such as 2,6-di-tert-butyl-p-cresol, a bisphenol such as 4,4'-methylenebis(2,6-di-t-butylphenol), and n-octadecyl 3-(4'-hydroxy-3',5'-di-tert-butylphenol)propionate. Examples of the amine-based antioxidant include an aromatic amine compound such as naphthylamine and a dialkyldiphenylamine. Examples of the organomolybdenum-based antioxidant include an organomolybdenum compound such as molybdenumamine. The content of the antioxidant in the engine oil composition according to one embodiment of the invention is preferably 0.05 to 5.0 mass %, and particularly preferably 0.5 to 3.0 mass %, based on the total mass of the engine oil composition.

The engine oil composition according to one embodiment of the invention may include a friction modifier. When the engine oil composition includes a friction modifier, it is possible to reduce friction in a boundary lubrication region, and further improve fuel efficiency. Examples of the friction modifier include an organomolybdenum compound, an ash-free friction modifier, and the like. Examples of the organomolybdenum compound include molybdenum dithiophosphate, molybdenum dithiocarbamate, a molybdenum acid amine compound, a molybdenum long-chain aliphatic amine compound, and the like. The content of the organomolybdenum compound in the engine oil composition according to one embodiment of the invention is preferably 100 to 1,200 ppm by mass (on a molybdenum atom basis) based on the total mass of the engine oil composition. Examples of the ash-free friction modifier include a long-chain aliphatic amine, a long-chain fatty acid ester, a long-chain aliphatic alcohol, an amide compound of an aliphatic amine and a fatty acid, an aliphatic polyglyceryl ether, and the like. The content of the ash-free friction modifier in the engine oil composition according to one embodiment of the invention is preferably 500 ppm by mass to 5 mass %, more preferably 1,000 ppm by mass to 4 mass %, and still more preferably 3,000 ppm by mass to 3 mass %, based on the total mass of the engine oil composition. The organomolybdenum compound and the ash-free friction modifier may be used either alone or in combination as the friction modifier. Note that it is preferable to use the ash-free friction modifier since the organomolybdenum compound may not exhibit a satisfactory effect due to soot when used for a diesel engine.

The engine oil composition according to one embodiment of the invention may optionally include various additives (e.g., metal deactivator, rust preventive, pour-point depressant, and defoamer) that are effective for providing the desired engine oil performance.

The engine oil composition according to one embodiment of the invention is prepared by appropriately mixing the base oil, the star polymer (A), the poly(alkyl (meth)acrylate) (B), and an optional additive. The components may be mixed in an arbitrary order.

The engine oil composition according to one embodiment of the invention has a viscosity index of 185 to 230, preferably 187 to 225, and particularly preferably 190 to 215. The engine oil composition according to one embodiment of the invention preferably has a kinematic viscosity at 40° C. (measured in accordance with JIS K 2283 (ASTM D445)) of 10 to 70 $mm^2/s$, more preferably 20 to 60 $mm^2/s$, and still more preferably 30 to 55 $mm^2/s$. The engine oil composition according to one embodiment of the invention preferably has a kinematic viscosity at 100° C. (measured in accordance with JIS K 2283 (ASTM D445)) of 5.6 to 12.5 $mm^2/s$, more preferably 8.5 to 11.5 $mm^2/s$, and still more preferably 9.3 to 11.0 $mm^2/s$. When the engine oil composition according to one embodiment of the invention conforms to the SAE viscosity grade 0W-30 or 5W-30 specified by SAE J300, the engine oil composition according to one embodiment of the invention exhibits excellent effects. The content of the viscosity index improver in the engine oil composition according to one embodiment of the invention is adjusted within the above range so that the engine oil composition according to one embodiment of the invention conforms to the SAE viscosity grade 0W-30 or 5W-30.

The engine oil composition according to one embodiment of the invention is applied to various engines. For example, the engine oil composition according to one embodiment of the invention is used for gasoline engines, diesel engines, gas engines, and the like. In particular, the engine oil composition according to one embodiment of the invention significantly improves fuel efficiency when used for diesel engines.

The invention is further described below by way of examples. Note that the invention is not limited to the following examples.

EXAMPLES

The base oil and the additives (see below) were mixed in the ratio shown in Tables 1 and 2 to obtain an engine oil composition. Note that the units "mass %" and "ppm by mass" in Tables 1 and 2 respectively refer to mass % and ppm by mass based on the total mass of the engine oil composition. The engine oil composition was prepared so as to conform to the SAE viscosity grade 0W-30 or 5W-30, have a kinematic viscosity at 100° C. (measured after a shear stability test performed in accordance with ASTM D6278-07) of 9.3 $mm^2/s$ or more (required under JASO DH-2 (Japanese diesel engine oil standard)), and have a high-temperature high-shear viscosity measured at a temperature of 150° C. and a shear rate of $1\times10^6$ of 3.0 mPa·s or more. The content of the viscosity index improver was minimized as long as the above conditions were satisfied taking account of the effect on fuel efficiency.

Base oil and additives used in examples and comparative examples (1) Base Oil

A mineral base oil (produced by hydrocracking) (Group III base oil) having a kinematic viscosity at 100° C. of 4.1 $mm^2/s$ and a viscosity index of 134 was used as the base oil.

(2) Viscosity Index Improver A

A star polymer including divinylbenzene at the center of the molecular structure, and including polymer chains obtained by copolymerization and hydrogenation of styrene, isoprene, and butadiene (weight average molecular weight: 595,000, active component content (excluding diluent oil): 11.0 mass %) was used as the viscosity index improver A.

(3) Viscosity Index Improver B

A poly(alkyl methacrylate) (weight average molecular weight: 440,000, active component content (excluding diluent oil): 19.7 mass %) was used as the viscosity index improver B.

(4) Viscosity Index Improver C

An ethylene-propylene copolymer (weight average molecular weight: 180,000, active component content (excluding diluent oil): 12.0 mass %) was used as the viscosity index improver C.

(5) Anti-Wear Agent

A zinc dialkyldithiophosphate including a primary-type alkyl group and a secondary-type alkyl group was used as the anti-wear agent.

(6) Dispersant

An alkenylsuccinimide (Mw=7,370, nitrogen content: 1.1 mass %, boron content: 0 mass %) was used as the dispersant A.

A boron-modified alkenylsuccinimide (Mw=4,380, nitrogen content: 1.4 mass %, boron content: 0.5 mass %) was used as the dispersant B.

(7) Metal-Based Detergent

Calcium salicylate (base number: 170 mgKOH/g) was used as the detergent A.

Calcium phenate (base number: 255 mgKOH/g) was used as the detergent B.

Note that the base number used herein refers to a value measured in accordance with JIS K 2501-6.

(8) Additional Additives

A phenol-based antioxidant, a pour-point depressant, and a silicone-based defoamer were used as additional additives.

Evaluation Methods

The evaluation methods used in connection with the examples and the comparative examples are described below.

(1) SAE Viscosity Grade

The viscosity grade was determined in accordance with SAE J300.

(2) Kinematic Viscosity

The kinematic viscosity (40° C. and 100° C.) and the viscosity index were measured in accordance with JIS K 2283 (ASTM D445).

(3) Viscosity Index

The viscosity index was calculated in accordance with JIS K 2283 (ASTM D2270).

(4) High-Temperature High-Shear Viscosity at a Temperature of 100° C. and a Shear Rate of $1\times10^6/s$ The high-temperature high-shear viscosity at a temperature of 100° C. and a shear rate of $1\times10^6/s$ was measured in accordance with ASTM D6616-07.

(5) High-Temperature High-Shear Viscosity at a Temperature of 150° C. and a Shear Rate of $1\times10^6/s$ The high-temperature high-shear viscosity at a temperature of 150° C. and a shear rate of $1\times10^6/s$ was measured in accordance with ASTM D4683.

(6) High-Temperature High-Shear Viscosity at a Temperature of 150° C. and a Shear Rate of $1\times10^7/s$ The high-temperature high-shear viscosity at a temperature of 150° C. and a shear rate of $1\times10^7/s$ was measured using an Ultra Shear Viscometer (USV) manufactured by PCS Instruments.

(7) Kinematic Viscosity at 100° C. Measured after Shear Stability Test

The engine oil was subjected to a shear stability test in accordance with ASTM D6278-07 (Standard Test Method for Shear Stability of Polymer Containing Fluids Using a European Diesel Injector Apparatus), and the kinematic viscosity at 100° C. was measured after the shear stability test.

Evaluation of Fuel Efficiency of Engine Oil Composition

The fuel efficiency of the engine oil composition was evaluated by performing a stationary fuel consumption test using a domestic diesel engine (4,600 cc). The testing conditions were set referring to the 10-15 mode specified by the Ministry of Land, Infrastructure, Transport and Tourism. Tables 1 and 2 show the fuel consumption improvement rate (%) with respect to the result of Comparative Example 1.

Coking Resistance Test

The coking weight was measured in accordance with the panel coking test method (Fed-791B). The oil temperature was set to 100° C., and the specimen panel temperature was set to 300° C. A cycle consisting of splash (15 seconds) and stop (45 seconds) was repeated three times, and the amount (mg) of deposit adhering to the specimen panel was measured.

TABLE 1

| | | Example 1 | Comparative Example 1 | Example 2 | Example 3 | Example 4 |
|---|---|---|---|---|---|---|
| Engine oil composition | | | | | | |
| Base oil | mass % | 73.80 | 78.20 | 73.70 | 72.45 | 75.30 |
| Viscosity index improver (A) | mass % ($M_A$) | 3.90 | — | 3.30 | 2.95 | 4.40 |
| | Active component content (mass %) | 0.43 | | 0.36 | 0.33 | 0.48 |
| Viscosity index improver (B) | mass % ($M_B$) | 8.70 | — | 9.10 | 11.00 | 6.70 |
| | Active component content (mass %) | 1.72 | | 1.80 | 2.17 | 1.32 |
| | $M_A/M_B$ | 0.25 | — | 0.20 | 0.15 | 0.37 |
| Viscosity index improver (C) | mass % | — | 8.20 | 0.30 | — | — |
| | Active component content (mass %) | | 0.98 | 0.04 | | |
| Anti-wear agent | P atom basis (ppm by mass) | 1,100 | 1,100 | 1,100 | 1,100 | 1,100 |
| Dispersant A | N atom basis (ppm by mass) | 380 | 380 | 380 | 380 | 380 |
| Dispersant B | B atom basis (ppm by mass) | 190 | 190 | 190 | 190 | 190 |
| Detergent A | Ca atom basis (ppm by mass) | 1,920 | 1,920 | 1,920 | 1,920 | 1,920 |

TABLE 1-continued

| | | Example 1 | Comparative Example 1 | Example 2 | Example 3 | Example 4 |
|---|---|---|---|---|---|---|
| Detergent B | Ca atom basis (ppm by mass) | 480 | 480 | 480 | 480 | 480 |
| Additional additive | mass % | 1.40 | 1.40 | 1.40 | 1.40 | 1.40 |
| SAE viscosity grade | | 5W-30 | 0W-30 | 5W-30 | 5W-30 | 5W-30 |
| Properties of engine oil composition | | | | | | |
| Kinematic viscosity (40° C.) | $mm^2/s$ | 47.96 | 54.49 | 47.74 | 47.43 | 48.74 |
| Kinematic viscosity (100° C.) | $mm^2/s$ | 9.995 | 10.28 | 10.10 | 10.23 | 9.940 |
| Viscosity index | | 202 | 180 | 206 | 211 | 197 |
| High-temperature high-shear viscosity (mPa · s) at a temperature of 100° C. and a shear rate of $1 \times 10^6/s$ | | 5.98 | 6.58 | 6.06 | 6.01 | 6.12 |
| High-temperature high-shear viscosity (mPa · s) at a temperature of 150° C. and a shear rate of $1 \times 10^6/s$ | | 3.00 | 3.07 | 3.09 | 3.13 | 3.05 |
| High-temperature high-shear viscosity (mPa · s) at a temperature of 150° C. and a shear rate of $1 \times 10^7/s$ | | 2.39 | 2.54 | 2.41 | 2.41 | 2.42 |
| Kinematic viscosity ($mm^2/s$) at 100° C. measured after shear stability test | | 9.3 | 9.4 | 9.3 | 9.3 | 9.4 |
| Engine oil fuel consumption test result (fuel consumption improvement rate (%) with respect to the result of Comparative Example 1) | | 0.78 | 0.00 | — | — | — |
| Panel coking test Amount (mg) of coking | | 153.7 | 86.1 | — | — | 149.0 |

TABLE 2

| | | Comparative Example 2 | Comparative Example 3 | Comparative Example 4 | Comparative Example 5 | Comparative Example 6 |
|---|---|---|---|---|---|---|
| Engine oil composition | | | | | | |
| Base oil | mass % | 65.40 | 72.60 | 77.60 | 69.80 | 78.90 |
| Viscosity index improver (A) | mass % ($M_A$) | — | — | 6.00 | 1.80 | 7.50 |
| | Active component content (mass %) | | | 0.66 | 0.20 | 0.83 |
| Viscosity index improver (B) | mass % ($M_B$) | 21.00 | 9.60 | 2.80 | 14.80 | — |
| | Active component content (mass %) | 4.15 | 1.90 | 0.55 | 2.92 | |
| $M_A/M_B$ | | — | — | 1.20 | 0.07 | — |
| Viscosity index improver (C) | mass % | — | 4.20 | — | — | — |
| | Active component content (mass %) | | 0.50 | | | |
| Anti-wear agent | P atom basis (ppm by mass) | 1,100 | 1,100 | 1,100 | 1,100 | 1,100 |
| Dispersant A | N atom basis (ppm by mass) | 380 | 380 | 380 | 380 | 380 |
| Dispersant B | B atom basis (ppm by mass) | 190 | 190 | 190 | 190 | 190 |
| Detergent A | Ca atom basis (ppm by mass) | 1,920 | 1,920 | 1,920 | 1,920 | 1,920 |
| Detergent B | Ca atom basis (ppm by mass) | 480 | 480 | 480 | 480 | 480 |
| Additional additive | mass % | 1.40 | 1.40 | 1.40 | 1.40 | 1.40 |
| SAE viscosity grade | | 0W-30 | 0W-30 | 5W-30 | 5W-30 | 5W-30 |
| Properties of engine oil composition | | | | | | |
| Kinematic viscosity (40° C.) | $mm^2/s$ | 46.59 | 47.95 | 51.30 | 47.44 | 55.53 |
| Kinematic viscosity (100° C.) | $mm^2/s$ | 11.25 | 10.18 | 10.09 | 10.71 | 10.55 |
| Viscosity index | | 245 | 207 | 189 | 225 | 183 |
| High-temperature high-shear viscosity (mPa · s) at a temperature of 100° C. and a shear rate of $1 \times 10^6/s$ | | 6.12 | 6.29 | 6.23 | 6.18 | 6.43 |
| High-temperature high-shear viscosity (mPa · s) at a temperature of 150° C. and a shear rate of $1 \times 10^6/s$ | | 3.40 | 3.10 | 3.01 | 3.25 | 3.00 |
| High-temperature high-shear viscosity (mPa · s) at a temperature of 150° C. and a shear rate of $1 \times 10^7/s$ | | 2.57 | 2.51 | 2.38 | 2.54 | 2.30 |
| Kinematic viscosity ($mm^2/s$) at 100° C. measured after shear stability test | | 9.6 | 9.3 | 9.7 | 9.5 | 10.0 |
| Engine oil fuel consumption test result (fuel consumption improvement rate (%) with respect to the result of Comparative Example 1) | | 0.39 | 0.37 | — | — | — |
| Panel coking test Amount (mg) of coking | | 211.7 | 164.2 | — | 218.8 | 55.0 |

As is clear from the results shown in Tables 1 and 2, the engine oil compositions of Examples 1 to 4 that included the star polymer (A) and the poly(alkyl (meth)acrylate) (B) as the viscosity index improver, wherein the content of the star polymer (A), the content of the poly(alkyl (meth)acrylate) (B), and the ratio ($M_A/M_B$) of the content of the star polymer (A) to the content of the poly(alkyl (meth)acrylate) (B) fall within the scope of the invention, showed a significant decrease in high-temperature high-shear viscosity at a temperature of 100° C. and a shear rate of $1\times10^6/s$ and high-temperature high-shear viscosity at a temperature of 150° C. and a shear rate of $1\times10^7/s$ (that have a correlation with fuel efficiency), as compared with the engine oil composition of Comparative Example 1 that included only the ethylene-propylene copolymer instead of the star polymer (A) and the poly(alkyl (meth)acrylate) (B), the engine oil composition of Comparative Example 2 that included only the poly(alkyl (meth)acrylate) (B) as the viscosity index improver (without including the star polymer (A)), and the engine oil composition of Comparative Example 3 that included the poly (alkyl (meth)acrylate) (B) and the ethylene-propylene copolymer as the viscosity index improver (without including the star polymer (A)). Note that the correlation between fuel efficiency and high-temperature high-shear viscosity is described in "*Tribology Sosho* 10*: Nainenkikan no Junkatsu*" (Saiwai Shobo Co. Ltd.), JSAE20085815 (2008), for example. The engine oil composition of Example 1 achieved significantly improved fuel efficiency as compared with the engine oil compositions of Comparative Examples 1 to 3 (see the results of the fuel consumption test). The engine oil compositions of Comparative Examples 4 and 5 that included the star polymer (A) and the poly(alkyl (meth) acrylate) (B) as the viscosity index improver, wherein the ratio ($M_A/M_B$) of the content of the star polymer (A) to the content of the poly(alkyl (meth)acrylate) (B) falls outside the scope of the invention, showed an increase in high-temperature high-shear viscosity at a temperature of 100° C. and a shear rate of $1\times10^6$/s or high-temperature high-shear viscosity at a temperature of 150° C. and a shear rate of $1\times10^71$ s, as compared with the engine oil compositions of Examples 1 to 4. Therefore, it is considered that the engine oil compositions of Comparative Examples 4 and 5 cannot sufficiently improve fuel efficiency. The engine oil composition of Comparative Example 6 that included only the star polymer (A) as the viscosity index improver (without including the poly(alkyl (meth)acrylate) (B)), had a viscosity index that falls outside the scope of the invention, and showed an increase in high-temperature high-shear viscosity at a temperature of 100° C. and a shear rate of $1\times10^6$/s as compared with the engine oil compositions of Examples 1 to 4. Therefore, it is considered that the engine oil composition of Comparative Example 6 cannot sufficiently improve fuel efficiency.

INDUSTRIAL APPLICABILITY

The embodiments of the invention can thus provide an engine oil composition that can significantly improve fuel efficiency.

The invention claimed is:

1. An engine oil composition comprising a star polymer (A) and a poly(alkyl (meth)acrylate) (B) as a viscosity index improver, wherein the star polymer (A) has a star structure and a weight average molecular weight of 100,000 to 1,000,000, the star structure being a structure in which polymer chains branch from a center of the polymer, the polymer chains being obtained by copolymerization and hydrogenation of an aromatic vinyl compound monomer and a conjugated diene monomer, wherein the poly(alkyl (meth)acrylate) (B) has a weight average molecular weight of 200,000 to 600,000, wherein a content ($M_A$) of the star polymer (A) in the engine oil composition being 0.10 to 2.00 mass % based on the total mass of the engine oil composition, a content ($M_B$) of the poly(alkyl (meth)acrylate) (B) in the engine oil composition being 0.50 to 6.00 mass % based on the total mass of the engine oil composition, and a ratio ($M_A/M_B$) of the content ($M_A$) of the star polymer (A) to the content ($M_B$) of the poly(alkyl (meth)acrylate) (B) being 0.10 to 1.00, and wherein the engine composition has a viscosity index of 185 to 230, and the engine oil composition conforms to the SAE viscosity grade 0W-30 or 5W-30 for a gasoline engine, diesel engine or gas engine.

2. The engine oil composition according to claim 1, wherein the aromatic vinyl compound monomer is styrene, and the conjugated diene monomer is either or both of isoprene and butadiene.

3. The engine oil composition according to claim 1, the engine oil composition being a diesel engine oil composition that conforms to the SAE viscosity grade 0W-30 or 5W-30.

4. The engine oil composition according to claim 2, the engine oil composition being a diesel engine oil composition that conforms to the SAE viscosity grade 0W-30 or 5W-30.

* * * * *